US006877257B2

(12) United States Patent
Delgorgue et al.

(10) Patent No.: US 6,877,257 B2
(45) Date of Patent: Apr. 12, 2005

(54) BOOT

(75) Inventors: Gerald Delgorgue, Ruffieux (FR); Catherine Fellouhe, Vieugy (FR); Thierry Donnadieu, Poisy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/800,702

(22) Filed: Mar. 16, 2004

(65) Prior Publication Data

US 2004/0172854 A1 Sep. 9, 2004

Related U.S. Application Data

(63) Continuation of application No. 10/023,987, filed on Dec. 21, 2001, now Pat. No. 6,772,540.

(30) Foreign Application Priority Data

Dec. 22, 2000 (FR) ..... 00 17126

(51) Int. Cl.[7] ..... A43B 23/08; A43B 23/00

(52) U.S. Cl. ..... 36/69; 36/45; 36/73; 36/87; 36/117.1; 36/19.5

(58) Field of Search ..... 36/45, 68, 69, 36/72 B, 73, 19.5, 84, 87, 92, 117.1, 117.2

(56) References Cited

U.S. PATENT DOCUMENTS

| | | | | | |
|---|---|---|---|---|---|
| 318,949 | A | | 6/1885 | Brown | 36/4 |
| 2,306,306 | A | | 12/1942 | Ferrettie | 36/4 |
| 2,798,312 | A | * | 7/1957 | Muller | 36/87 |
| 3,798,804 | A | | 3/1974 | Funck | 36/72 R |
| 4,246,708 | A | * | 1/1981 | Gladek | 36/107 |
| 4,322,895 | A | * | 4/1982 | Hockerson | 36/129 |
| 4,447,967 | A | | 5/1984 | Zaino | 36/45 |
| 4,638,576 | A | * | 1/1987 | Parracho et al. | 36/68 |
| 4,821,430 | A | * | 4/1989 | Flemming et al. | 36/69 |
| 5,189,814 | A | * | 3/1993 | Barma | 36/4 |
| 5,317,820 | A | | 6/1994 | Bell et al. | 36/89 |
| 5,379,530 | A | | 1/1995 | Bell et al. | 36/89 |
| 5,448,840 | A | * | 9/1995 | Cheskin | 36/32 R |
| 5,477,593 | A | | 12/1995 | Leick | 24/712.5 |
| 5,499,459 | A | | 3/1996 | Tomaro | 36/10 |
| 5,647,150 | A | | 7/1997 | Romanato et al. | 36/117.1 |
| 5,678,329 | A | | 10/1997 | Griffin et al. | 36/50.1 |
| 5,704,138 | A | | 1/1998 | Donnadieu | 36/58.5 |
| 5,727,271 | A | | 3/1998 | Romanato et al. | 12/142 RS |
| 5,732,483 | A | | 3/1998 | Cagliari | 36/115 |
| 5,884,420 | A | * | 3/1999 | Donnadieu | 36/117.5 |
| 5,899,006 | A | | 5/1999 | Donnadieu | 36/97 |
| 5,940,990 | A | | 8/1999 | Barret | 36/55 |
| 5,946,827 | A | | 9/1999 | Okajima | 36/58.5 |
| 5,950,335 | A | | 9/1999 | Okajima | 36/115 |
| 5,966,841 | A | | 10/1999 | Barret | 36/50.1 |
| 6,076,285 | A | | 6/2000 | Caeran et al. | 36/115 |
| 6,772,540 | B1 | * | 8/2004 | Delgorgue et al. | 36/50.5 |
| 2002/0078599 | A1 | | 6/2002 | Delgorgue et al. | 36/98 |

FOREIGN PATENT DOCUMENTS

| | | |
|---|---|---|
| EP | 0753268 | 1/1997 |
| EP | 0754413 | 1/1997 |
| FR | 2706743 | 12/1994 |
| FR | 2743989 | 8/1997 |
| GB | 393508 | 6/1933 |
| WO | WO94/04051 | 3/1994 |

* cited by examiner

*Primary Examiner*—M. D. Patterson
(74) *Attorney, Agent, or Firm*—Greenblum & Bernstein, P.L.C.

(57) ABSTRACT

A boot that includes a sole and an outer upper having an impervious portion, with at least one outer reinforcing element assembled to the upper by cementing at least in the impervious portion thereof. Preferably, the reinforcing element includes a heel reinforcement and lateral tightening flaps.

38 Claims, 4 Drawing Sheets

143
144

142
140
114
120
126
160
118
119
113
111
141
110
115
150
117
121
116
112
121
130

BOOT

CROSS-REFERENCE TO RELATED APPLICATIONS

This application is a continuation of U.S. patent application Ser. No. 10/023,987, filed on Dec. 21, 2001, now U.S. Pat. No. 6,772,540 the disclosure of which is hereby incorporated by reference thereto in its entirety, and the priority of which is hereby claimed under 35 U.S.C. §120.

This application is based upon French Patent Application No. 00.17126, filed Dec. 22, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an at least partially impervious boot construction adapted in particular for use in winter.

2. Description of Background and Relevant Information

Various methods are known for making a shoe impervious, i.e., impervious to water penetration. They include, for example, providing an inner liner made of a breathable and impervious material; but this construction is costly because the breathable and impervious material is very expensive and all the seams must be made impervious by sealing joints added by gluing.

Another method is to immerse the finished boot into a latex or PVC bath, up to the desired level of imperviousness. This construction is also expensive to implement, because it requires a very long processing time and costly investments.

SUMMARY OF THE INVENTION

An object of the present invention is to propose a boot whose construction is simple and cost advantageous, while having the desired characteristics, especially in terms of comfort, heat, imperviousness.

This object is achieved in the present invention due to the fact that the boot includes a sole, an outer upper having an impervious portion, and an outer reinforcing element assembled to the upper by cementing, at least in the impervious portion thereof.

Indeed, the fact that the outer reinforcement is cemented and not sewn, as in the usual boot constructions, generally makes it possible to preserve the imperviousness of the boot and to avoid the use of expensive means to seal the seams which would have been generated.

BRIEF DESCRIPTION OF DRAWINGS

The invention will be better understood from the description that follows, with reference to the annexed schematic drawings showing, by way of a non-limiting example, a preferred embodiment, and in which.

DETAILED DESCRIPTION OF THE INVENTION

Figure 1:
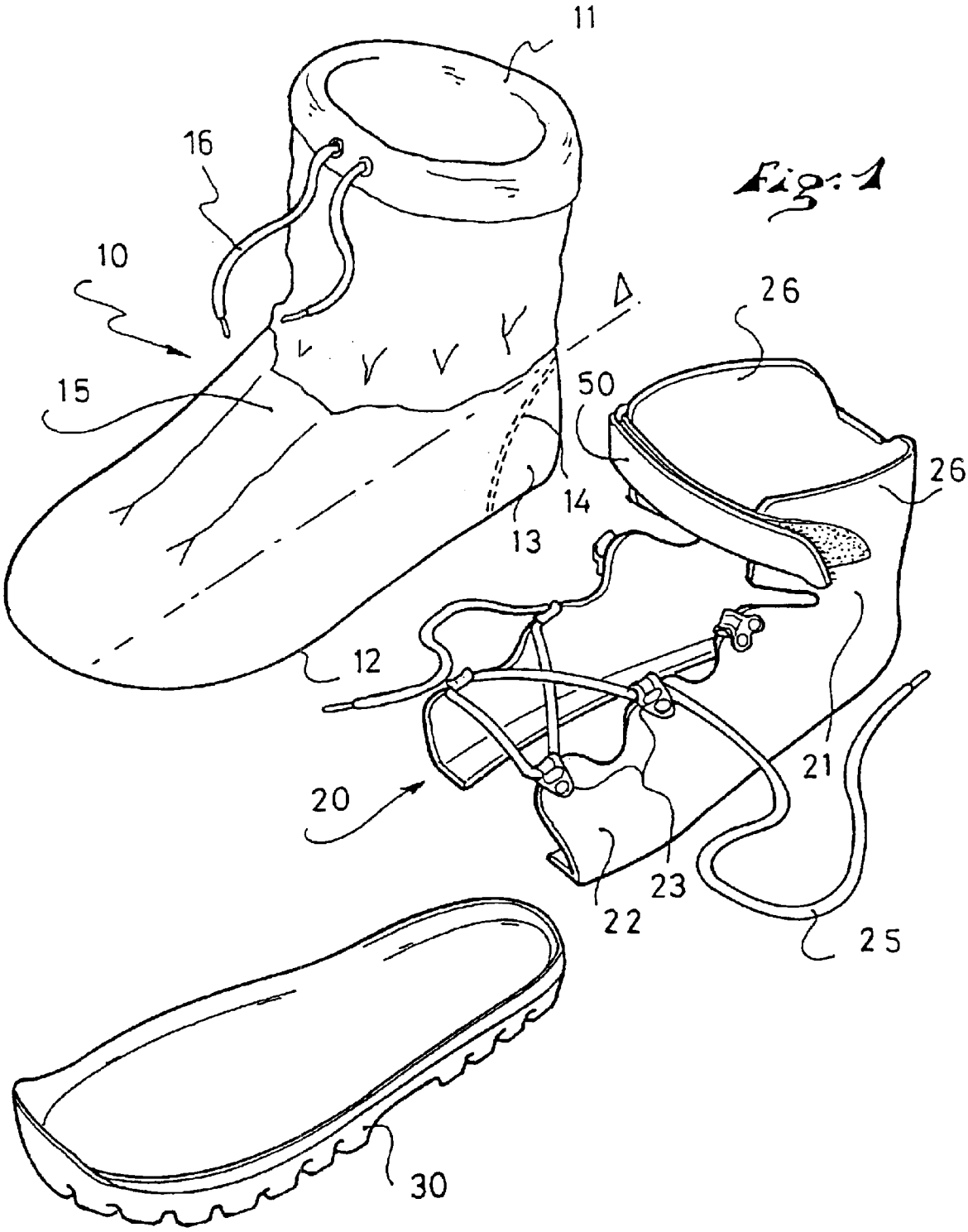
FIG. 1 is an exploded perspective view of the outer upper of the boot before assembly.

As shown in FIG. 1, the boot according to the invention includes:

an outer sole 30;

a flexible upper closed in the form of a boot, i.e., a high upper 10 having a single opening 11 at its upper end, the upper 10 being made of a flexible and impervious material, especially leather or a coated fabric, and is closed at its lower end by a sole 12, especially made of PVC;

a reinforcement 20 including a rear portion, or heel reinforcement, 21 surrounding the heel, and two lateral flaps 22 connected to the rear reinforcement 21 and covering the upper 10 of the boot, from the outer sole 30 up to the instep 15 of the upper;

wherein each lateral flap 22 has keepers 23 at its upper end, which are adapted to receive a lace 25 for tightening the outer upper 10 of the boot in the instep zone.

In the illustrated embodiments, including that shown in FIG. 1, the reinforcement 20 has a front end that is located intermediate the ends of the boot, whereby the lateral flaps 22 are spaced from the front end of the boot.

In the context of the invention, "impervious" means resistant to water penetration; one may wish this resistance to be more or less substantial depending on the use intended for the shoe.

Preferably, the reinforcement 20 is a polymeric material, such as flexible polyurethane, and has various stiffening zones depending on the desired effect. Thus, the reinforcement 20 is thicker in its rear portion 21 to ensure a good nesting and a good retention/protection of the heel. The heel reinforcement 21 and tightening flaps 22 assembly is also preferably molded to shape in order to obtain an adaptation to the foot and an optimum tightening.

According to a preferred construction, the reinforcement assembly 20/21/22 is assembled on the outer upper 10 by cementing, in a cementing zone extending from the outer sole 30 up to at least an upper cementing limit Δ extending substantially to mid-height of the upper. The cement is preferably a polyurethane-base cement.

This construction makes it possible to:

guarantee the imperviousness of the boot, because it requires a minimum number of stitched seams, which are always detrimental to a good imperviousness;

simplify the construction as much as possible and, therefore, to reduce the cost proportionately, because the entire outer upper is flexible and the only stiffening/tightening means are located on a single element, namely the reinforcement/tightening flap assembly, and because the fixing of the reinforcement assembly 20/21/22 by cementing, instead of the conventional stitched seams, avoids the use of costly sealing techniques;

still obtain an efficient tightening, which is generally not the case in a high boot-type construction, because the upper ends of the tightening flaps are free in relation to the upper;

dissociate the aspects of imperviousness, provided by the outer upper, and of comfort/heat, provided by the inner liner.

If necessary, the flexible upper 11 itself can be provided with a heel stiffener 13 assembled to the upper by a seam 14 which, as shown in FIG. 1, extends downwardly and forwardly at the side of the upper; in this case, the seam 14 is covered and made impervious by the reinforcement 21/tightening flaps 22 assembly, and is therefore completely protected from the outside, since the cementing of the reinforcement assembly 20/21/22 extends up to the cementing line Δ and, therefore, above the seam 14. In this case, the stiffness of the outer heel reinforcement 21 is adapted to that of the inner heel stiffener 13.

Depending on the height of the boot, complementary tightening means can be provided in the area of the ankle/lower leg. In this case, these tightening means are constituted by a strap 50 provided with Velcro-type self-gripping means adapted to bring the two wings 26 of a vertical extension of the reinforcement 21 closer together by forming a collar around the lower part of the leg. In any event, the only means 25, 50 for tightening the boot around the foot are located on the reinforcement portion 20 of the outer upper 10. A closure means, in this case a lace 16, can also be provided to close the opening 11 of the upper 10 and avoid any penetration of water, snow, etc., inside the latter. The inner liner 40 can have any construction.

Preferably, the inner liner 40 is detachable, so that it can be easily cleaned and dried, for example.

Advantageously, the liner is provided, at its lower end, with a preferably cemented thick sole 41 corresponding to a through middle, so-called cup, of a conventional outer sole.

This sole 41 is made of a shock-absorbing material such as a PU, EVA foam.

Providing this sole 41 on the liner, and therefore within the boot, has numerous advantages:

- the sole 41 is kept warm inside the boot, and does not harden when cold, which would have the effect of eliminating the shock absorbing characteristics thereof, and the boot therefore remains comfortable regardless of the outside conditions;
- the sole 41 integrates a so-called ΔH height difference between the heel and the front zone of the foot, and therefore makes it easier to walk with the liner alone;
- the sole/liner subassembly is inserted inside the outer upper and is therefore completely detachable;
- the overall product has excellent characteristics of comfort, shock absorption, heat, and imperviousness, at a particularly advantageous cost.

Figure 4:
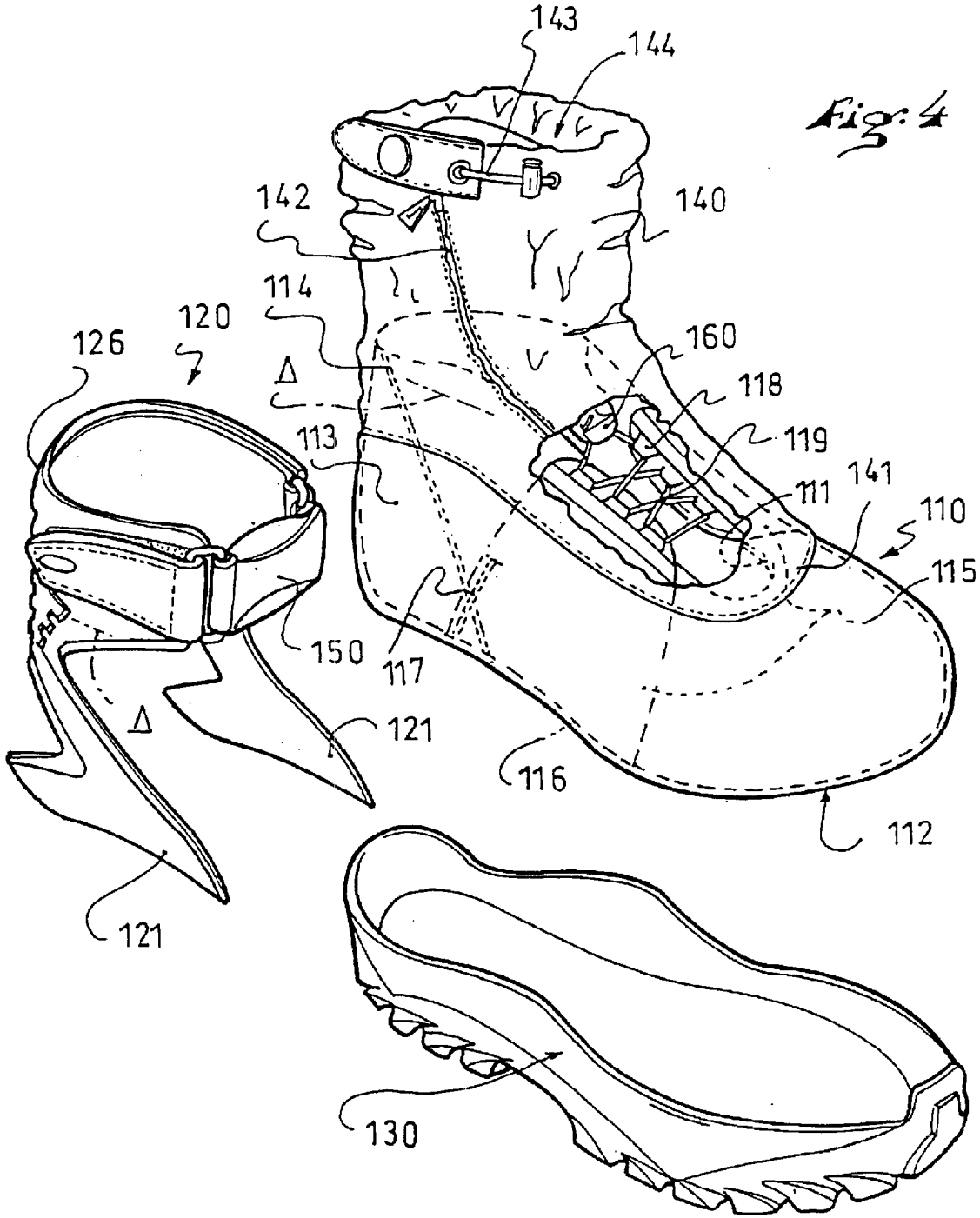
FIG. 4 is a view, similar to FIG. 1, of the outer upper of a boot according to a second embodiment.

The embodiment of FIG. 4 essentially distinguishes over the preceding embodiment in that the tightening means are essentially arranged within the boot.

The boot shown in FIG. 4 includes:

- an outer sole 130;
- a mid-height upper 110 made of an impervious material such as a coated fabric and is provided at its upper end, or top, along the forefoot region of the upper 110, with a wide longitudinally extending opening 111 and, at its lower end, or bottom, with a sole 112, and having, in the heel zone, a heel stiffener 113 assembled to the upper by seams 114, the latter having at least a portion extending, as shown in FIG. 4, downwardly and forwardly at the side of the upper 110;
- an impervious gaiter 140 sewn at 141 along the opening 111 of the upper and rising along the leg of the user, the gaiter 140 being provided with a longitudinal lateral opening closed by a zipper 142 and with a rope 143 for tightening its upper opening 144;
- a reinforcement 120 including a rear portion or heel reinforcement having two arms 121 laterally covering the heel zone of the mid-height upper 110, extending downwardly and forwardly over the seams 114, and extending upwardly by joining one another to form a collar 126 surrounding the upper portion of the upper 141 and the gaiter 140, the collar 126 being provided with Velcro-type tightening means 150 or the like.

Figure 2:
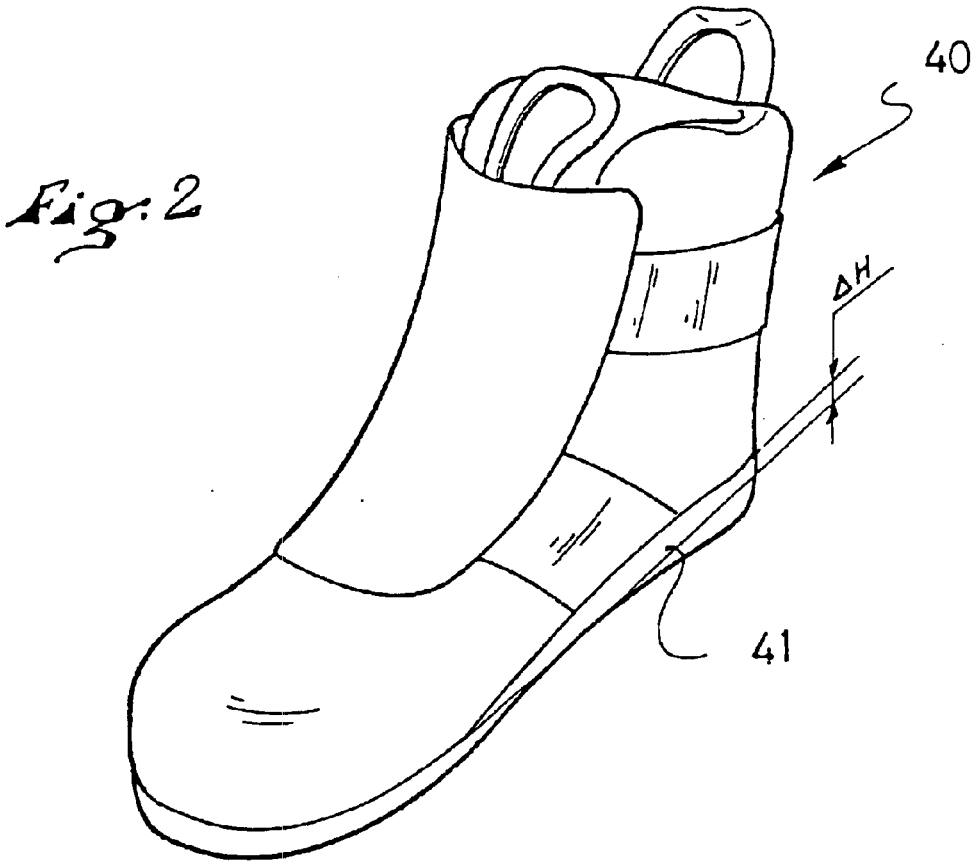
FIG. 2 is a view of the liner.
Figure 3:
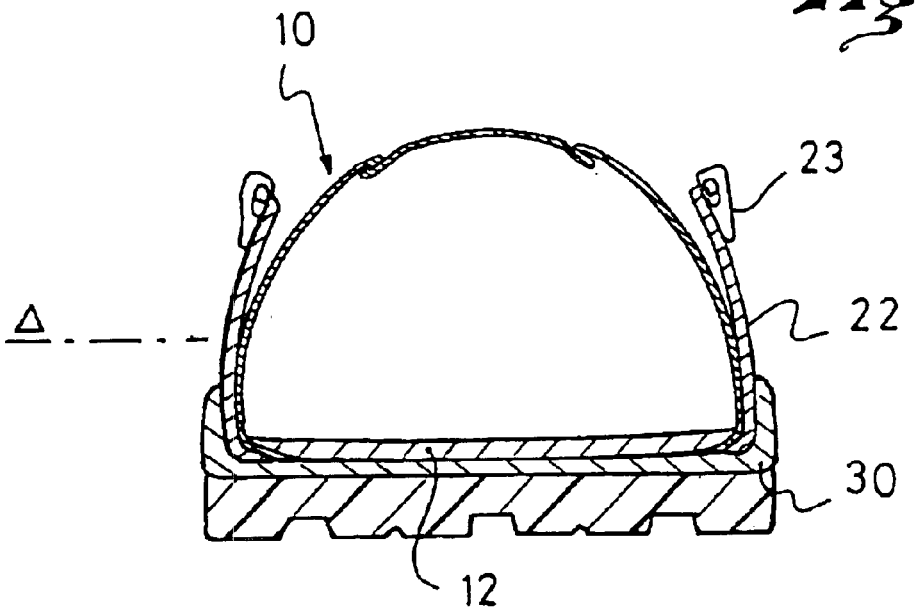
FIG. 3 is a transverse cross-sectional view of the assembled boot, without the liner.

A detachable liner (not shown in FIG. 4), similar to the liner 40 of FIG. 2, is adapted to be inserted within the upper to provide comfort and the desired characteristics of thermal insulation and shock absorption.

The mid-height upper 110 is further provided with an inner tightening system constituted of two flexible flaps 115, respectively medial and lateral, extending in the instep zone of the boot. These two flaps 115 are fixed at their lower end 116 to the upper 110 and to the sole 130, in particular in the common assembly zone 112 of the latter called the lasting allowance.

These two flaps 115 are further fixed to the upper 110 in their rear zone by a seam 117. The role of the seams 117 is to reinforce the linkage of the flaps to the upper, on the one hand, and to facilitate the positioning of the liner; the flaps 115 fixed in their rear zone do not hinder its insertion.

The tightening flaps 115 are provided at their free upper end with keepers 118 receiving a lace 119 for tightening the user's foot inside the upper 110. The lace 119 can be closed by a knot, or by a blocking system 160 as known from the French Patent No. 2 706 743.

As in the preceding example, the upper reinforcement 120 is fixed to the upper 110 of the boot up to mid-height of the latter, i.e., from the outer sole 130 up to the upper cementing limit Δ. In the example of FIG. 4, the cementing limit Δ is located above the lower extent of the gaiter 140.

As mentioned above, the shape of the upper reinforcement 120 is provided so as to cover and to seal, by its cementing, all of the seams 117, 114 of the upper 110 located in an impervious portion of the upper.

As a result, the only seams left to be made impervious are those 141 connecting the gaiter to the upper, these seams being made impervious in a known fashion by an application of cement or of an impervious film on the inner side of the upper 110.

Whether in the embodiment of FIG. 1 or of FIG. 4, the cementing of the outer reinforcement 20, 120 on the upper over a large surface of the reinforcement makes it possible, due to a simple and inexpensive construction, to guarantee a good imperviousness of the boot while, surprisingly, being sufficiently resistant to withstand the forces, especially the tensile forces exerted on the reinforcement during the tightening of at least its upper portion 50, 150.

Figure 5:
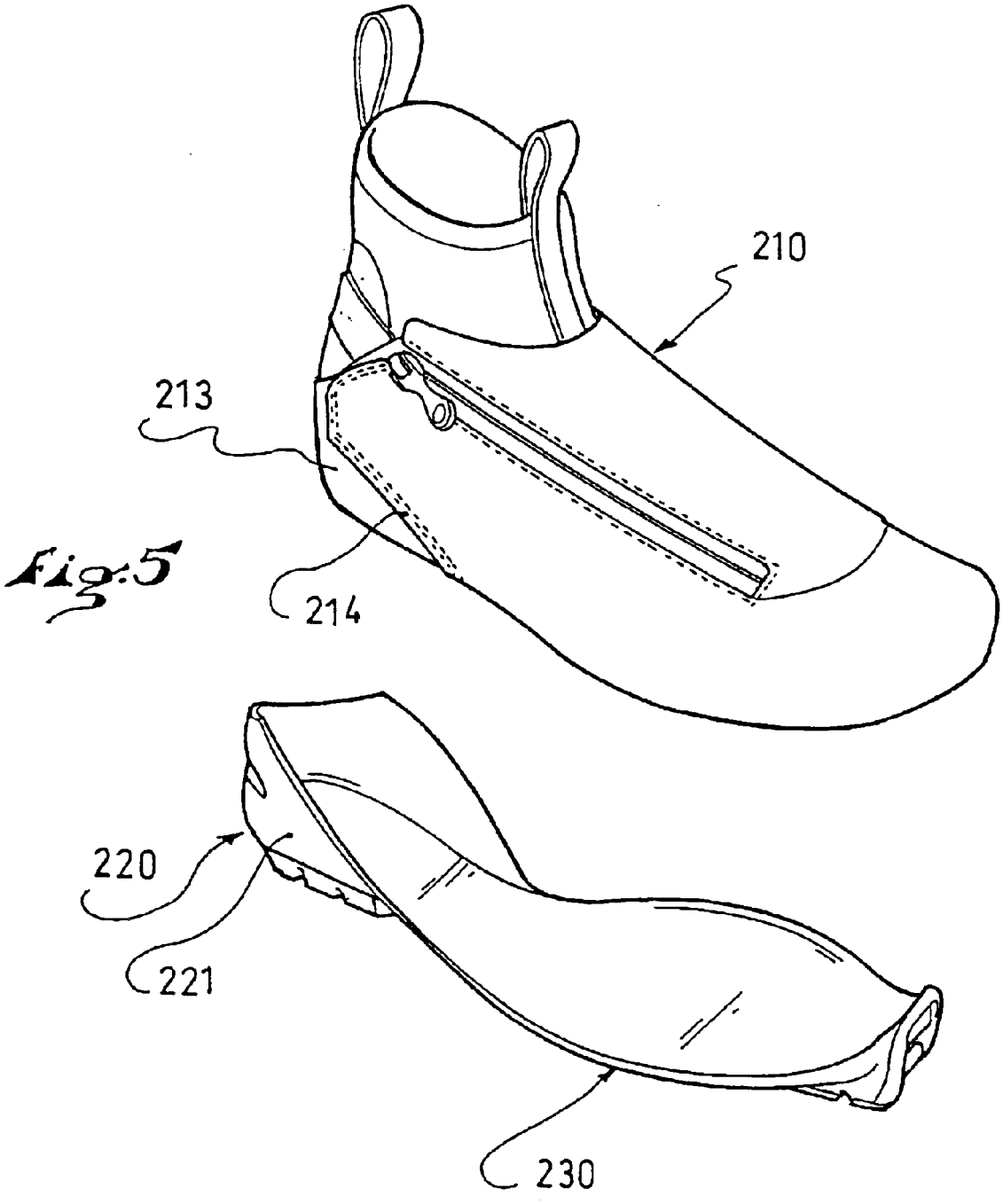
FIG. 5 is a view, similar to FIG. 1, of a boot according to a third embodiment.

In the embodiment shown in FIG. 5, the boot is composed of an outer sole 230, a mid-height upper 210 including, at the rear, a heel stiffener 213 assembled to the upper 210 by seams 214, the upper 210 covering the heel stiffener 213 from the outside. The lower part of the seam 214 visible in FIG. 5 can be seen to extend downwardly and forwardly at the side of the upper 210.

As in the preceding embodiments, a supplemental reinforcement 220 including a heel zone 221 is cemented at the rear on the heel stiffener 213, covering the seams 214 for assembling the stiffener to the upper, thus obtaining their imperviousness.

The only difference of this embodiment with respect to the preceding embodiments is that the reinforcement 220 is affixed to the outer sole 230, and is therefore cemented to the upper concurrently with the latter.

In this case, the reinforcement 220 is made of the same material as the outer sole 230. The sole 230 can also be obtained in two portions rather than one, that is, rather than being unitary with the reinforcement, namely a rigid and substantially non-flexible rear portion which is then affixed to the reinforcement 220, and a more flexible front portion, as described in the document FR 2 743 989.

The present invention is not limited to the embodiments described hereinabove, by way of non-limiting examples, but encompasses all similar or equivalent embodiments.

What is claimed is:

1. A boot comprising:

a outer sole;

an outer upper comprising an impervious portion;

a heel stiffener positioned within and stitched to said outer upper along at least one stitched seam having at least a portion extending downwardly and forwardly;

at least one outer reinforcing element extending along said outer upper from said outer sole, said at least one outer reinforcing element assembled to said outer upper with cement at least in said impervious portion of said outer upper, said outer reinforcing element covering said stitched seam.

2. A boot according to claim 1, wherein:

said outer reinforcing element surrounds a heel region of said outer upper and includes arms extending downwardly and forwardly over said stitched seam.

3. A boot according to claim 1, wherein:

said outer reinforcing element is a separate element from said outer sole.

4. A boot according to claim 1, wherein:

said outer reinforcing element is unitary with said outer sole.

5. A boot according to claim 1, wherein:

said reinforcing element comprises a heel reinforcement.

6. A boot according to claim 5, wherein:

said heel reinforcement comprises a vertical extension forming a collar for tightening said outer upper to a lower leg of a wearer of the boot.

7. A boot according to claim 6, wherein:

said collar comprises the only means for tightening said outer upper to the lower leg of the wearer.

8. A boot according to claim 5, wherein:

said outer heel reinforcement is affixed on at least one portion of said outer sole.

9. A boot according to claim 1, further comprising:

an inner tightening system comprising two flexible flaps fixed within said outer upper by means of at least one stitched seam, said at least one stitched seam covered by said outer reinforcing element.

10. A boot according to claim 1, further comprising:

a detachable liner provided with a sole made of a shock-absorbing material.

11. A boot according to claim 1, wherein:

said impervious portion of said outer upper extends downwardly to said outer sole.

12. A boot according to claim 1, wherein:

at least said impervious portion of said outer upper comprises a coating for effecting imperviousness.

13. A boot according to claim 1, wherein said:

said outer reinforcing element is assembled to said outer upper only by means of cement.

14. A boot according to claim 13, wherein:

at least said impervious portion of said outer upper comprises a coating for effecting imperviousness.

15. A boot according to claim 1, wherein:

said cement extends to an upper cementing limit;

said at least one outer reinforcing element is attached to said outer upper up to said upper cementing limit only by means of said cement.

16. A boot according to claim 1, wherein:

said outer upper comprises a flexible fabric.

17. A boot according to claim 16, wherein:

at least said impervious portion includes an impervious coating on said outer upper.

18. A boot according to claim 1, wherein:

said impervious portion of said outer upper comprises a coated fabric.

19. A boot comprising:

an outer sole;

at least one outer reinforcing element;

at least one additional part comprising at least one impervious portion, said at least one impervious portion comprising an outer upper, said outer upper extending longitudinally substantially from a front end to a rear end of the boot;

said outer reinforcing element extending along a lesser longitudinal extent than said outer upper;

said outer reinforcing element being attached with cement to said at least one impervious portion of the boot from a lower end of said at least one impervious portion of the boot up to a cementing limit, said outer reinforcing element extending above said cementing limit.

20. A boot according to claim 19, wherein:

said outer reinforcing element above said cementing limit comprises at least part of a tightening system for tightening the boot onto a wearer.

21. A boot according to claim 20, wherein:

said tightening system comprises a pair of laterally spaced flaps formed by said outer reinforcing element above said cementing limit adapted to tighten the boot onto a foot of the wearer.

22. A boot according to claim 20, wherein:

said tightening system comprises a collar formed by said outer reinforcing element above said cementing limit adapted to tighten the boot onto a lower leg of the wearer.

23. A boot according to claim 19, wherein:

said at least one additional part further comprises a gaiter spaced above said outer sole and attached to said outer upper.

24. A boot according to claim 23, wherein:

said outer reinforcing element is attached to said gaiter and extends from said gaiter above said cementing limit.

25. A boot according to claim 23, wherein:

said cementing limit is positioned at a height above a lower extent of said gaiter;

said outer reinforcing element is cemented to said gaiter up to said cementing limit.

26. A boot according to claim 25, wherein:

said outer reinforcing element above said cementing limit comprises a collar adapted to tighten the boot onto a lower leg of a wearer.

27. A boot according to claim 19, wherein:

said cement extends to an upper cementing limit;

said at least one outer reinforcing element is attached to said outer upper up to said upper cementing limit only by means of said cement.

28. A boot according to claim 19, wherein:

said outer reinforcement comprises a lateral portion and a medial portion;

each of said lateral and medial portions of said outer reinforcement comprises an upper edge extending downwardly and forwardly to said lower end of said at least one additional part at an intermediate portion spaced from said front end of the boot.

29. A boot according to claim 28, wherein:

said at least one additional part further comprises a heel stiffener attached to said outer upper by means of stitched seams extending downwardly and forwardly on lateral and medial sides of the boot;

said outer reinforcement completely covers said stitched seams.

30. A boot according to claim 19, wherein:

said outer upper is made of a flexible material.

31. A boot according to claim 19, wherein:

said outer reinforcing element is attached to said at least one additional part only with said cement.

32. A boot according to claim 19, wherein:

above said sole, the boot includes no stitching on an exposed outer surface of said outer upper.

33. A boot according to claim 32, wherein:

said outer reinforcing element covers stitching on an outer surface of said outer upper.

34. A boot according to claim 19, wherein:

said outer upper further comprises a longitudinally extending opening in a forefoot region;

the boot further comprises a gaiter attached to said outer upper, said gaiter covering said longitudinally extending opening of said outer upper.

35. A boot according to claim 34, wherein:

said gaiter is attached to said outer upper with stitching.

36. A boot according to claim 19, wherein:

said cement is located in a cementing zone extending from said sole to substantially mid-height of said outer upper.

37. A boot according to claim 19, wherein:

at least said impervious portion of said outer upper comprises a coating for effecting imperviousness.

38. A boot according to claim 19, further comprising:

a detachable liner positioned within said outer upper, said liner being provided with a sole.

* * * * *